US010567872B2

(12) United States Patent
Maeno et al.

(10) Patent No.: US 10,567,872 B2
(45) Date of Patent: Feb. 18, 2020

(54) LOCALLY SILENCED SOUND FIELD FORMING APPARATUS AND METHOD

(71) Applicant: SONY CORPORATION, Tokyo (JP)

(72) Inventors: Yu Maeno, Tokyo (JP); Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/301,501

(22) PCT Filed: May 17, 2017

(86) PCT No.: PCT/JP2017/018501
§ 371 (c)(1),
(2) Date: Nov. 14, 2018

(87) PCT Pub. No.: WO2017/208822
PCT Pub. Date: Dec. 7, 2017

(65) Prior Publication Data

US 2019/0208315 A1 Jul. 4, 2019

(30) Foreign Application Priority Data

May 30, 2016 (JP) ..... 2016-107356

(51) Int. Cl.
*H04R 3/00* (2006.01)
*H04R 1/20* (2006.01)
(Continued)

(52) U.S. Cl.
CPC ..... *H04R 1/403* (2013.01); *G10K 11/178* (2013.01); *H04R 3/00* (2013.01)

(58) Field of Classification Search
CPC ... H04R 3/00; H04R 3/04; H04R 3/12; H04R 1/20; H04R 1/24; H04R 1/32; H04R 1/40;
(Continued)

(56) References Cited

U.S. PATENT DOCUMENTS 8,077,873 B2 * 12/2011 Shridhar ..... G10K 11/178 381/71.1
8,116,488 B2 * 2/2012 Nagasawa ..... H04R 3/00 381/302
(Continued)

FOREIGN PATENT DOCUMENTS

JP 2006-270409 A 10/2006
JP 2007-121439 A 5/2007

OTHER PUBLICATIONS

International Search Report and Written Opinion of PCT Application No. PCT/JP2017/018501, dated Aug. 15, 2017, 06 pages of ISRWO.
(Continued)

*Primary Examiner* — Thang V Tran
(74) *Attorney, Agent, or Firm* — Chip Law Group

(57) ABSTRACT

The present technology relates to a locally silenced sound field forming apparatus and method capable of controlling a silenced area in a depth direction. The locally silenced sound field forming apparatus includes a first speaker array that outputs a sound on the basis of a first speaker drive signal to form a predetermined sound field, and a second speaker array arranged at a position different from the position of the first speaker array and that outputs a sound on the basis of a second speaker drive signal to form a sound field that cancels the predetermined sound field. The present technology can be applied to a locally silenced sound field forming apparatus.

10 Claims, 11 Drawing Sheets

(51) Int. Cl.
*H04R 1/40* (2006.01)
*G10K 11/178* (2006.01)

(58) Field of Classification Search
CPC ..... H04R 1/178; H04R 1/403; H04R 1/1083; H04R 5/00; H04R 5/02; H04R 2499/13; H04R 2227/005
See application file for complete search history.

(56) References Cited

U.S. PATENT DOCUMENTS

| | | | | |
|---|---|---|---|---|
| 8,311,233 | B2 * | 11/2012 | Kinghorn | H04S 7/301 381/110 |
| 9,706,320 | B2 * | 7/2017 | Starobin | H04R 27/00 |
| 10,080,088 | B1 * | 9/2018 | Yang | H04S 7/30 |
| 2005/0271223 | A1 * | 12/2005 | Itabashi | H04R 1/403 381/98 |
| 2006/0215853 | A1 | 9/2006 | Hiruma et al. | |
| 2007/0098183 | A1 | 5/2007 | Enamito et al. | |
| 2012/0039480 | A1 * | 2/2012 | Willems | H04R 3/12 381/71.1 |
| 2015/0208166 | A1 * | 7/2015 | Raghuvanshi | H04R 3/002 381/71.6 |
| 2016/0088388 | A1 * | 3/2016 | Franck | H04R 27/00 381/305 |
| 2019/0052962 | A1 * | 2/2019 | Abe | H04S 1/00 |

OTHER PUBLICATIONS

Kamakura, et al., "Practical Development of a Parametric Loudspeaker", The Journal of the Acoustical Society of Japan, vol. 62, No. 11 (2006), pp. 791-797.

* cited by examiner

LOCALLY SILENCED SOUND FIELD FORMING APPARATUS AND METHOD

CROSS REFERENCE TO RELATED APPLICATIONS

This application is a U.S. National Phase of International Patent Application No. PCT/JP2017/018501 filed on May 17, 2017, which claims priority benefit of Japanese Patent Application No. JP 2016-107356 filed in the Japan Patent Office on May 30, 2016. Each of the above-referenced applications is hereby incorporated herein by reference in its entirety.

TECHNICAL FIELD

The present technology relates to a locally silenced sound field forming apparatus and method, and a program, and more particularly relates to a locally silenced sound field forming apparatus and method, and a program capable of controlling a silenced area in a depth direction.

BACKGROUND ART

Conventional methods for suppressing a sound in a specific area in formation of a sound field include a method of performing directivity control using a parametric speaker or a linear speaker array.

For example, there is a proposed method of local silencing by super-directivity control using a parametric speaker (refer to Non-Patent Document 1, for example). This method arranges units of the parametric speaker in the horizontal direction or physically moving or rotating the unit to enable moving an area to be silenced in the left and right directions as viewed from the speaker.

Furthermore, according to the method of performing local silencing by directivity control using a linear speaker array, it is possible to move the area to be silenced in the left and right direction as viewed from the linear speaker array by using digital signal processing.

CITATION LIST

Non-Patent Document

Non-Patent Document 1: Kamakura et al., "Practical development of a parametric loudspeaker," Journal of Acoustical Society of Japan, vol. 62, p. 791-797, 2006.

SUMMARY OF THE INVENTION

Problems to be Solved by the Invention

The above-described technique, however, has difficulty in controlling the area to be silenced in the depth direction as viewed from the speaker. In other words, in a case where local silencing is performed by directivity control using a parametric speaker or a linear speaker array, it is difficult to provide the silenced area at a desired position in the depth direction.

On the other hand, in a case where a parametric speaker is used, there is a limitation in frequency bands available for reproduced sounds, leading to limitation in content to be reproduced.

The present technology has been made in view of such a situation, and aims to achieve control of silenced area in the depth direction.

Solutions to Problems

A locally silenced sound field forming apparatus according to an aspect of the present technology includes: a first speaker array that outputs a sound on the basis of a first speaker drive signal to form a predetermined sound field; and a second speaker array arranged at a position different from the position of the first speaker array and that outputs a sound on the basis of a second speaker drive signal to form a sound field that cancels the predetermined sound field.

The locally silenced sound field forming apparatus can further include: an acquisition unit that obtains information regarding a silenced area that cancels the predetermined sound field; and a drive signal generation unit that generates the first speaker drive signal and the second speaker drive signal on the basis of the information regarding the silenced area.

The acquisition unit can be configured to obtain, as the information regarding the silenced area, a first distance from the first speaker array to the silenced area and a second distance from the second speaker array to the silenced area.

The drive signal generation unit can be configured to generate the second speaker drive signal that forms a sound field having an inverted phase of that in the predetermined sound field in the silenced area.

The drive signal generation unit can be configured to generate a first spatial frequency spectrum of the first speaker drive signal on the basis of the first distance and generate a second spatial frequency spectrum of the second speaker drive signal on the basis of the second distance, and it is possible to further provide a spatial frequency combining unit that performs spatial frequency combining on each of the first spatial frequency spectrum and the second spatial frequency spectrum to generate a first temporal frequency spectrum and a second temporal frequency spectrum, respectively; and a temporal frequency combining unit that performs temporal frequency combining on each of the first temporal frequency spectrum and the second temporal frequency spectrum to generate the first speaker drive signal and the second speaker drive signal, respectively.

The drive signal generation unit can be configured to convolute a filter coefficient corresponding to the first distance, and a sound source signal, to generate the first speaker drive signal, and convolute a filter coefficient corresponding to the second distance, and the sound source signal, to generate the second speaker drive signal.

The locally silenced sound field forming apparatus can include a plurality of the second speaker arrays.

Distances between the first speaker array and each of the plurality of second speaker arrays can be different from each other.

The first speaker array and the second speaker array can be each provided as a linear speaker array or an annular speaker array.

A locally silenced sound field forming method or program according to an aspect of the present technology is a locally silenced sound field forming method or program for a locally silenced sound field forming apparatus including a first speaker array and a second speaker array arranged at a different position from the first speaker array, the method or program including: outputting a sound by the first speaker array on the basis of a first speaker drive signal to form a predetermined sound field; and outputting a sound by the second speaker array on the basis of a second speaker drive signal to form a sound field that cancels the predetermined sound field.

According to one aspect of the present technology, in a locally silenced sound field forming apparatus including a first speaker array and a second speaker array arranged at a different position from the first speaker array, a sound is output by the first speaker array on the basis of a first speaker drive signal to form a predetermined sound field, and a sound is output by the second speaker array on the basis of a second speaker drive signal to form a sound field that cancels the predetermined sound field.

Effects of the Invention

According to one aspect of the present technology, it is possible to control the silenced area in the depth direction.

Note that effects described herein are non-restricting. The effects may be any effects described in the present disclosure.

MODE FOR CARRYING OUT THE INVENTION

Hereinafter, embodiments of the present technology will be described with reference to the drawings.

First Embodiment

About the Present Technology

The present technology uses two speaker arrays having different arrangement positions so as to enable providing a silenced area on a desired control point in the depth direction as viewed from the speaker.

The present technology uses two speaker arrays to form a sound field simultaneously including: a region in which the sound locally decreases only at a point a specific distance away from the speaker array (hereinafter referred to as a silenced area); and a region in which sounds can be heard and located in front and rear of the silenced area (hereinafter referred to as a "reproduction area"), in a depth direction as viewed from the speaker arrays.

Figure 1:
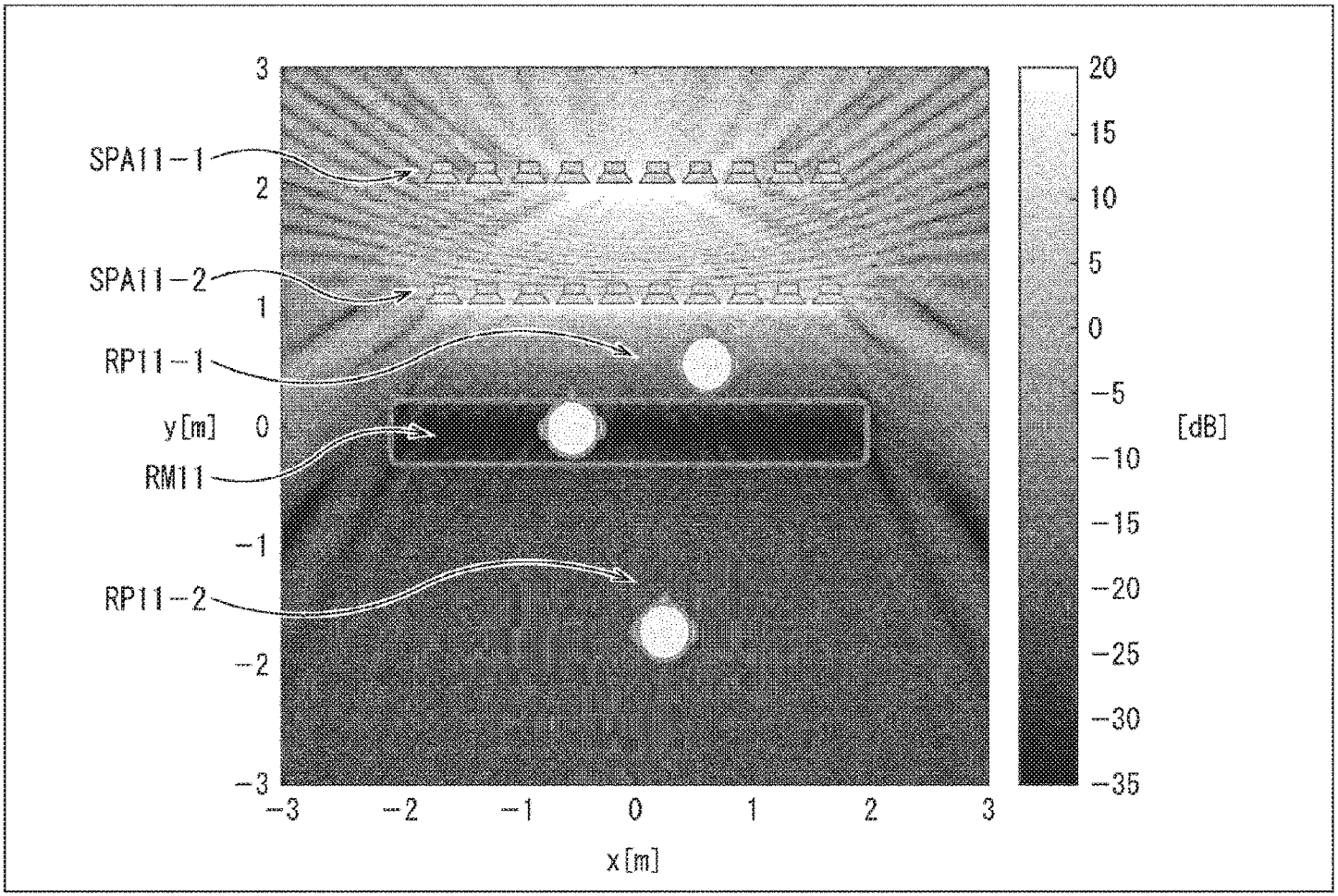
FIG. 1 is a diagram illustrating an outline of the present technology.

For example, the present technology uses two speaker arrays, namely, a speaker array SPA 11-1 and a speaker array SPA 11-2, to form a silenced area RM 11, and reproduction areas RP 11-1 and RP 11-2 respectively positioned in front and rear of the silenced area RM 11, as illustrated in FIG. 1. Note that the shading in FIG. 1 indicates sound pressure at each of positions of the sound fields formed.

In this example, the two speaker arrays, namely, the speaker array SPA 11-1 and the speaker array SPA 11-2, each of which being formed with a plurality of speakers arranged in the horizontal direction (hereinafter referred to as an x-direction) in the figure, are arranged in the vertical direction (hereinafter referred to as a "y-direction") with a predetermined distance between each other in the figure.

Here, one of the two speaker arrays, namely, the speaker array SPA 11-1 and the speaker array SPA 11-2, is a speaker array for forming a desired sound field, while the other is a speaker array for forming a sound field that cancels the desired sound field on a predetermined control point.

Hereinafter, the speaker array SPA 11-1 and the speaker array SPA 11-2 will also be simply referred to as the speaker array SPA 11 unless there is no particular need to make a distinction.

Note that while the speaker array SPA 11 is illustrated as a linear speaker array in this example, it is not limited to this, and a planar speaker array obtained by arranging speakers on a flat surface, an annular speaker array obtained by arranging speakers in an annular (circular) shape, or the like may be used as the speaker array SPA 11.

Moreover, several speakers may be selected to be used as an annular speaker array from among the speakers constituting the spherical speaker array, or several speakers may be selected to be used as a linear speaker array from among the speakers constituting the planar speaker array.

The example illustrated in FIG. 1 is a sound field formation using the two speaker arrays SPA 11, in which the reproduction area RP 11-1, the silenced area RM 11, and the reproduction area RP 11-2 are formed to be arranged in the y-direction that is the direction perpendicular to the direction in which the speakers constituting the speaker array SPA 11 are arranged. That is, the silenced area RM 11 being a locally silenced region is formed at a desired position in the depth direction as viewed from the speaker array SPA 11.

Therefore, users in the reproduction area RP 11-1 and the reproduction area RP 11-2 can hear the sound being reproduced, while the user in the silenced area RM 11 cannot hear the reproduced sound.

Meanwhile, in the sound field formation using the speaker array SPA 11 being a linear speaker array, there is a need to set a control point parallel to the speaker array SPA 11.

The control point of the speaker array SPA 11 is a position where the distance in a direction that is perpendicular to the direction in which the speakers constituting the speaker array SPA 11 are arranged, that is, in the y-direction in FIG. 1 is a predetermined distance as viewed from the speaker array SPA 11. Accordingly, the control point is on a straight line parallel to the speaker array SPA 11, that is, a straight line parallel to the x-direction.

In formation of the sound field using the speaker array SPA 11, the sound pressure and the phase can be set to be agreement with an ideal desired sound field on the control point, while an error occurs in the sound pressure in the other areas. The present technology utilizes this error to form the silenced area RM 11 by means of the two speaker arrays SPA 11.

Figure 2:
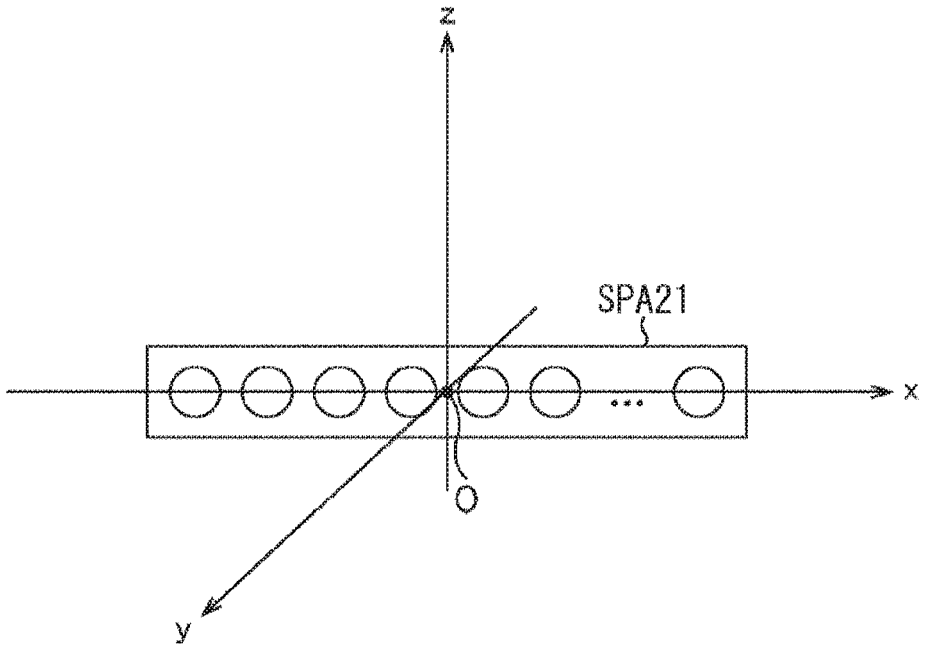
FIG. 2 is a diagram illustrating a coordinate system.

Here, the coordinate system used in the description in the following will be described with reference to FIG. 2.

That is, in the following description, the center position of the speaker array SPA 21 being a linear speaker array is set as an origin O of a three-dimensional orthogonal coordinate system.

The speaker array SPA 21 corresponds to the speaker array SPA 11 illustrated in FIG. 1 and a speaker array of a locally silenced sound field forming apparatus to be described later. The speaker array SPA 21 includes a plurality of speakers arranged linearly in the horizontal direction in the figure.

Furthermore, three axes of the three-dimensional orthogonal coordinate system are defined as an x-axis, a y-axis, and a z-axis passing through the origin O and orthogonal to each other. Here, the direction of the x-axis, that is, the x-direction is defined as a direction in which the speakers constituting the speaker array SPA 21 are arranged. Furthermore, the direction of the y-axis, that is, the y-direction is defined as a direction parallel to the direction in which a sound wave is output from the speaker array SPA 21, while a direction perpendicular to the x-direction and the y-direction is defined as the z-axis direction, that is, the z-direction. In particular, the direction in which the sound wave is output from the speaker array SPA 21 is defined as a positive direction in the y-direction.

Hereinafter, a spatial position, that is, a vector indicating a spatial position will also be represented as (x, y, z) using the x-coordinate, the y-coordinate, and the z-coordinate.

Next, an example of attenuation in distance in sound pressure in a case where a point sound source is formed at a predetermined position by using the two speaker arrays SPA 11 illustrated in FIG. 1 will be described with reference to FIG. 3.

Figure 3:
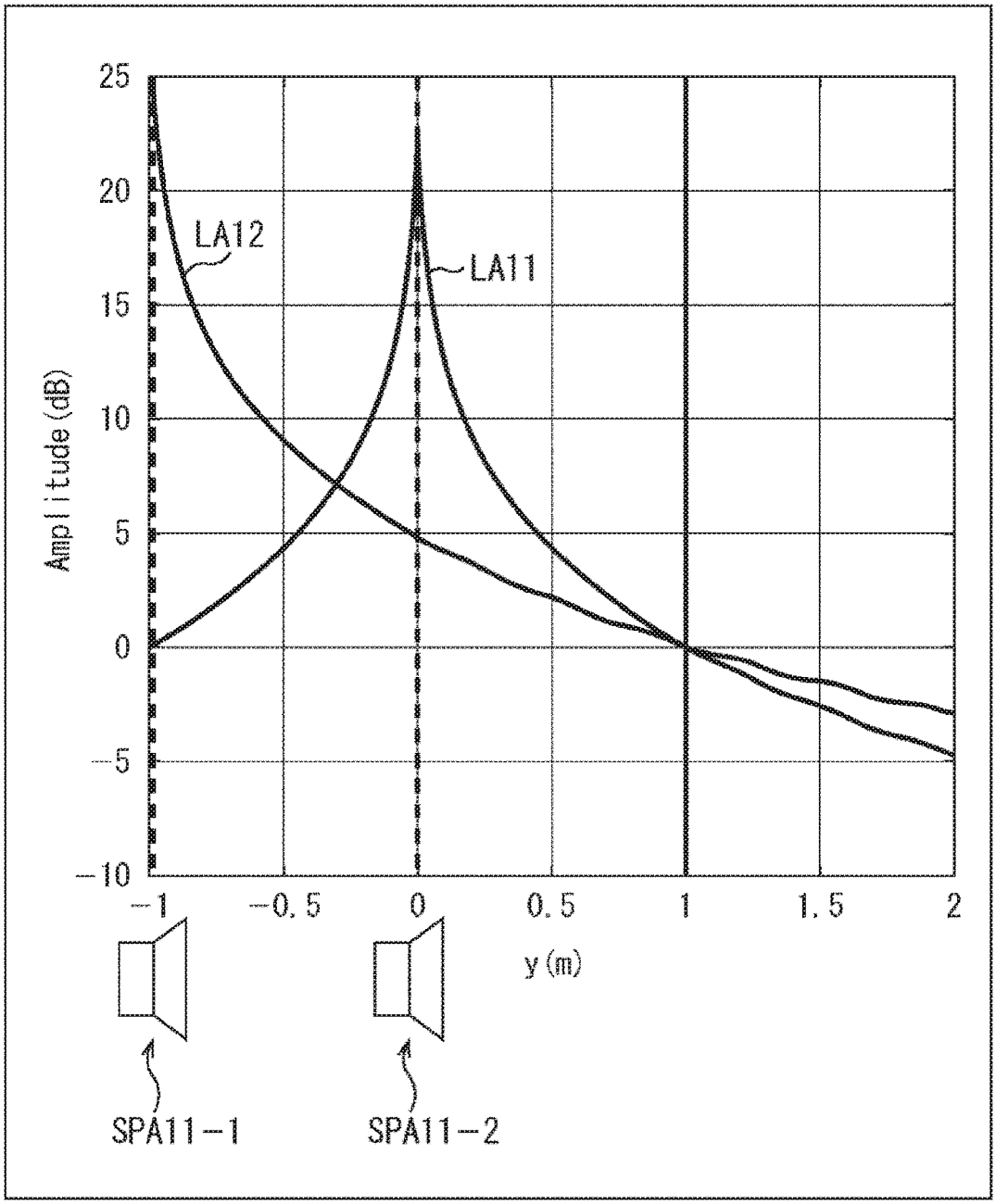
FIG. 3 is a diagram illustrating attenuation in distance in a sound pressure at sound field formation.

Note that portions in FIG. 3 corresponding to those in FIG. 1 are denoted by the same reference numerals, and description thereof is omitted. Furthermore, in FIG. 3, the horizontal axis indicates the position in the y-direction and the vertical axis indicates the sound pressure.

In the example illustrated in FIG. 3, the speaker array SPA 11-2 is located at a position where the position in the y-direction is 0, that is, at position of y=0, while the speaker array SPA 11-1 is located at a position where the position in the y-direction is y=−1. Furthermore, in this example, the control points of the two speaker arrays SPA 11 are both set to positions where y=1.

Moreover, a curve LA 11 illustrates a sound pressure at each of positions of the sound reproduced by the speaker array SPA 11-2, while a curve LA 12 illustrates a sound pressure at each of positions of the sound reproduced by the speaker array SPA 11-1.

In this example in particular, the speaker arrays SPA 11, namely, the speaker array SPA 11-2 and the speaker array SPA 11-1 are driven such that their sound pressures of sounds from individual speaker arrays are equal to each other at a point of y=1 which is the control point.

However, while the sound pressures of the sounds from the two speaker arrays SPA 11 are perfectly in agreement with each other at the control point, the sound pressures of the sounds from the two speaker arrays SPA 11 are not in agreement at positions other than the control point.

As described above, in a case where the sound field is formed by the speaker array SPA 11, the sound pressure and the phase can be set to the target sound pressure and phase at the single position of y=1 being the control point, and an error occurs in the sound pressure at the position other than the control point.

Therefore, the present technology utilizes such characteristics to reproduce sounds to form sound fields at the position of y=1 as the control point so as to have exactly inverted phase between the speaker array SPA 11-1 and the speaker array SPA 11-2.

That is, for example, one speaker array SPA 11 outputs the sound on the basis of a speaker drive signal that forms a desired sound field with the position of y=1 as a control point. In contrast, the other speaker array SPA 11 outputs the sound on the basis of a speaker drive signal that forms a sound field that cancels the desired sound field formed by the one speaker array SPA 11 with the position of y=1 as the control point.

With this configuration, the sound reproduced by one of the speaker arrays SPA 11 is canceled by the sound reproduced by the other speaker array SPA 11 at the position of y=1 being the control point, so as to set the region of the control point to be the silenced area.

Furthermore, a reproduction area as an audible area is produced in the regions in front and rear of the silenced area in the y-direction, due to the difference in the sound reproduced by each of the two speaker arrays SPA 11, that is, the difference in the sound pressures of individual sound fields. With this mechanism, it is possible to form the reproduction area RP 11-1, the silenced area RM 11, and the reproduction area RP 11-2, as illustrated in FIG. 1, for example.

In this manner, according to the present technology, with the use of two speaker arrays, it is possible to form a silenced area at a desired position in the depth direction, that is, the y-direction when viewed from the speaker array, while forming a desired wave surface in the reproduction areas in front and rear of the silenced area. Furthermore, the silenced area can be moved in the y-direction with a certain degree of freedom.

Configuration Example of Locally Silenced Sound Field Forming Apparatus

Next, a more specific embodiment of the present technology described above will be described.

Figure 4:
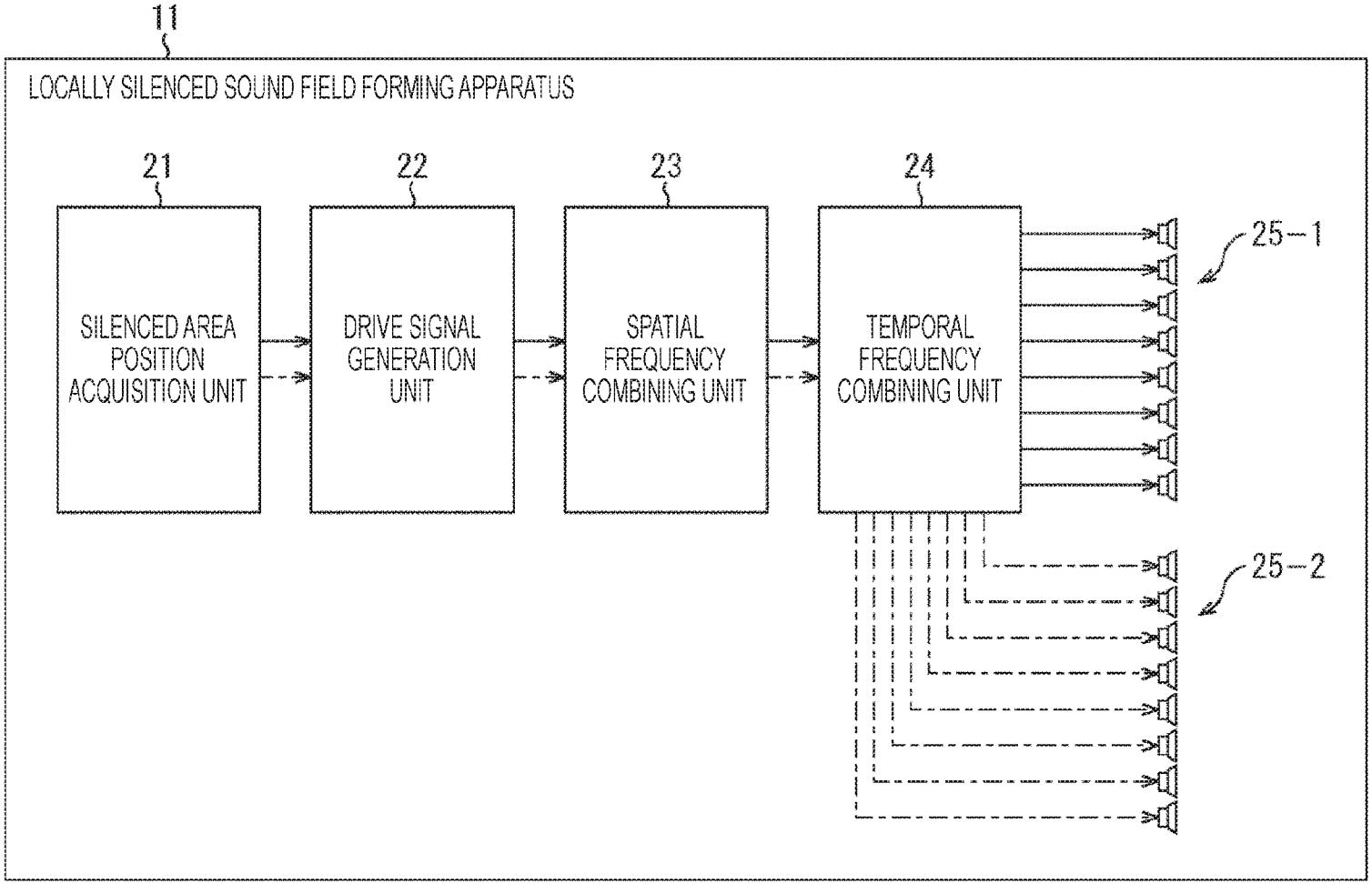
FIG. 4 is a diagram illustrating a configuration example of a locally silenced sound field forming apparatus.

FIG. 4 is a diagram illustrating a configuration example of an embodiment of a locally silenced sound field forming apparatus according to the present technology The locally silenced sound field forming apparatus 11 illustrated in FIG. 4 includes a silenced area position acquisition unit 21, a drive signal generation unit 22, a spatial frequency combining unit 23, a temporal frequency combining unit 24, a speaker array 25-1, and a speaker array 25-2. Note that hereinafter, the speaker array 25-1 and the speaker array 25-2 will also be referred to simply as the speaker array 25 unless there is no particular need to make a distinction.

The locally silenced sound field forming apparatus 11 is effective in a case where the positions of the speaker array 25-1 and the speaker array 25-2 and the position of the silenced area are substantially fixed and are not frequently changed, for example. In particular, according to the locally silenced sound field forming apparatus 11, there is no need to perform filter coefficient convolution processing on sound source signals required in a second embodiment.

The silenced area position acquisition unit 21 obtains a distance $y_{ref1}$ in the y-direction from the speaker array 25-1 to the position to be the silenced area and a distance $y_{ref2}$ in the y-direction from the speaker array 25-2 to the position to be the silenced area, as information regarding the silenced area, and supplies the obtained information to the drive signal generation unit 22.

On the basis of the distance $y_{ref1}$ and the distance $y_{ref2}$ supplied from the silenced area position acquisition unit 21, the drive signal generation unit 22 generates, for each of the speaker arrays 25, a spatial frequency spectrum of a speaker drive signal for allowing the speaker array 25 to reproduce the sound and supplies the generated spectrum to the spatial frequency combining unit 23.

The spatial frequency combining unit 23 performs spatial frequency combining on the spatial frequency spectrum of the speaker drive signal supplied from the drive signal generation unit 22 for each of the speaker arrays 25 and supplies a temporal frequency spectrum thus obtained to the temporal frequency combining unit 24.

For each of the speaker arrays 25, the temporal frequency combining unit 24 performs temporal frequency combining on the temporal frequency spectrum supplied from the spatial frequency combining unit 23 so as to obtain a speaker drive signal of the speaker array 25 which is a temporal signal. The temporal frequency combining unit 24 supplies the obtained speaker drive signal to the speaker array 25 to reproduce the sound.

The speaker array 25-1 and the speaker array 25-2 include a linear speaker array, a planar speaker array, and the like, for example, and reproduce sounds on the basis of the speaker drive signal supplied from the temporal frequency combining unit 24.

For example, the speaker array 25-1 outputs a sound on the basis of the speaker drive signal to form a predetermined sound field, and at the same time, the speaker array 25-2 outputs a sound on the basis of the speaker drive signal to form a sound field that cancels the sound field formed by the speaker array 25-1. With this configuration, a reproduction area and a silenced area are formed, achieving formation of the locally silenced sound field in which the sound field is locally silenced.

The speaker array 25-1 and the speaker array 25-2 respectively correspond to the speaker array SPA 11-1 and the speaker array SPA 11-2 illustrated in FIG. 1, and are arranged at different positions from each other. Specifically, the two speaker arrays 25 are arranged at mutually different positions in the y-direction.

Note that the positions of the two speaker arrays 25 in the x-direction and the positions in the z-direction may be configured to be different from each other, and it would be possible to realize the formation of the locally silenced sound field particularly even in a case where the position in the z-direction alone is different. Still, the following description will be given on the assumption that the positions of the speaker arrays 25 are different only in the y-direction.

Silenced Area Position Acquisition Unit

Subsequently, individual portions of the locally silenced sound field forming apparatus 11 illustrated in FIG. 4 will be described in more detail. First, the silenced area position acquisition unit 21 will be described.

The silenced area position acquisition unit 21 obtains the distance $y_{ref1}$ and the distance $y_{ref2}$ to the silenced area. For example, the silenced area position acquisition unit 21 may be configured to obtain the distance $y_{ref1}$ and the distance $y_{ref2}$ that are supplied from an external device or input by a user or the like.

Furthermore, it is allowable to configure such that the silenced area position acquisition unit 21 detects the position to be the silenced area to calculate the distance $y_{ref1}$ and the distance $y_{ref2}$ so as to obtain the distance $y_{ref1}$ and the distance $y_{ref2}$.

For example, the silenced area position acquisition unit 21 includes a camera, a sensor, or the like, in a case where the silenced area position acquisition unit 21 detects the position to be the silenced area. In this case, the silenced area position acquisition unit 21 recognizes an object such as a listener using the camera or the sensor, and detects the position of the silenced area on the basis of a recognition result.

Specifically, for example, the silenced area position acquisition unit 21 detects a user from an image photographed by the camera, determines the position to be the silenced area from the detection result, as well as calculating the spatial distance from the speaker array 25 to the position to be the silenced area in the y-direction as the distance $y_{ref1}$ and the distance $y_{ref2}$. In this case, for example, the position of the user to whom the sound is to be suppressed among the detected users is set as the position of the silenced area.

Drive Signal Generation Unit

The drive signal generation unit 22 calculates the spatial frequency spectrum of the speaker drive signal of each of the speaker arrays 25 on the basis of the distance $y_{ref1}$ and the distance $y_{ref2}$ obtained as silenced area position information.

For example, a sound field $P(v, n_{tf})$ in three-dimensional free space is expressed as illustrated in the following Formula (1).

[Mathematical Expression 1]

$$P(v,n_{tf})=\int_{\infty}^{-\infty}D(v_0,n_{tf})G(v,v_0,n_{tf})dx_0 \tag{1}$$

Note that in Formula (1), $n_{tf}$ indicates a temporal frequency index, and v is a vector indicating a spatial position, and v=(x, y, z). Furthermore, in Formula (1), $v_0$ is a vector indicating a predetermined position on the x-axis and $v_0=(x_0, 0, 0)$. Note that hereinafter a position indicated by a vector v will also be referred to as a position v, and a position indicated by a vector $v_0$ will also be referred to as a position $v_0$.

Moreover, in Formula (1), $D(v_0, n_{tf})$ represents a drive signal of a secondary sound source, while $G(v, v_0, n_{tf})$ is a transfer function between the position v and the position $v_0$. The drive signal $D(v_0, n_{tf})$ of the secondary sound source corresponds to the speaker drive signal of the speaker constituting the speaker array 25.

The calculation of Formula (1) takes a form of convolution of the drive signal $D(v_0, n_{tf})$ and the transfer function $G(v, v_0, n_{tf})$ in the spatial domain, and the sound field $P(v, n_{tf})$ illustrated in Formula (1) can be spatially Fourier transformed in the x-axis direction, into the following Formula (2).

[Mathematical Expression 2]

$$P_F(n_{sf},y,z,n_{tf})=D_F(n_{sf},n_{tf})G_F(n_{sf},y,z,n_{tf}) \tag{2}$$

Note that in Formula (2), $n_{sf}$ represents the spatial frequency index.

When the sound field $P(v, n_{tf})$ is spatially Fourier transformed in this manner, the sound field $P_F(n_{sf}, y, z, n_{tf})$ in the spatial frequency domain is expressed by the product of the drive signal $D_F(n_{sf}, n_{tf})$ and the transfer function $G_F(n_{sf}, y, z, n_{tf})$, as indicated by Formula (2). Accordingly, the spatial frequency representation of the drive signal of the secondary sound source is as illustrated in the following Formula (3).

[Mathematical Expression 3]

$$D_F(n_{sf}, n_{tf}) = \frac{P_F(n_{sf}, y, z, n_{tf})}{G_F(n_{sf}, y, z, n_{tf})} \tag{3}$$

Furthermore, it is known that in the use of a secondary sound source on a straight line, a sound field practically formed can be brought into agreement with an ideal sound field only on a control point parallel to the straight line. This is described in, for example, "Jens Ahrens, Sascha Spors, "Sound Field Reproduction Using Planar and Linear Arrays of Loudspeakers", IEEE TRANSACTIONS ON AUDIO, SPEECH, AND LANGUAGE PROCESSING, 2010", and the like.

Accordingly, assuming that the position of the control point is a position $y=y_{ref}$ and that $z=0$ in consideration of the sound field on the horizontal plane, Formula (3) can be expressed by the following Formula (4).

[Mathematical Expression 4]

$$D_F(n_{sf}, n_{tf}) = \frac{P_F(n_{sf}, y_{ref}, 0, n_{tf})}{G_F(n_{sf}, y_{ref}, 0, n_{tf})} \tag{4}$$

The drive signal $D_F(n_{sf}, n_{tf})$ of the secondary sound source indicated by Formula (4) is a drive signal for forming an ideal sound field at the control point of the position $y=y_{ref}$.

Furthermore, as a desired sound field $P_F(n_{sf}, y_{ref}, 0, n_{tf})$, it is possible to utilize a point sound source model $P_{PS}(n_{sf}, y_{ref}, 0, n_{tf})$ as illustrated in the following Formula (5), for example.

[Mathematical Expression 5]

$$P_{ps}(n_{sf}, y_{ref}, 0, n_{tf}) = S(n_{tf}) \times e^{jk_x x_{ps}} \times \begin{cases} -\frac{j}{4} H_0^{(2)}\left(\sqrt{\left(\frac{\omega}{c}\right)^2 - k_x^2}\,(y_{ref} - y_{ps})\right), & |k_x| < \left|\frac{\omega}{c}\right| \\ \frac{1}{2\pi} K_0\left(\sqrt{k_x^2 - \left(\frac{\omega}{c}\right)^2}\,(y_{ref} - y_{ps})\right), & \left|\frac{\omega}{c}\right| < |k_x| \end{cases} \tag{5}$$

Note that in Formula (5), $S(n_{tf})$ indicates a sound source signal of a sound to be reproduced, j indicates an imaginary unit, and $k_x$ indicates a wave number in the x-axis direction. Furthermore, $x_{ps}$ and $y_{ps}$ indicate x and y-coordinates indicating the position of the point sound source respectively, ω indicates an angular frequency, and c indicates sound velocity. Moreover, $H_0^{(2)}$ indicates the second-type Hankel function, and $K_0$ indicates the Bessel function.

Furthermore, the transfer function $G_F(n_{sf}, y_{ref}, 0, n_{tf})$ can be expressed by the following Formula (6).

[Mathematical Expression 6]

$$G_F(n_{sf}, y_{ref}, 0, n_{tf}) = \begin{cases} -\frac{j}{4} H_0^{(2)}\left(\sqrt{\left(\frac{\omega}{c}\right)^2 - k_x^2}\, y_{ref}\right), & |k_x| < \left|\frac{\omega}{c}\right| \\ \frac{1}{2\pi} K_0\left(\sqrt{k_x^2 - \left(\frac{\omega}{c}\right)^2}\, y_{ref}\right), & \left|\frac{\omega}{c}\right| < |k_x| \end{cases} \tag{6}$$

With the use of the above Formula (4), Formula (5), and Formula (6), the drive signal generation unit 22 obtains a spatial frequency spectrum $D_{F1}(n_{sf}, n_{tf})$ of the speaker drive signal of the speaker array 25-1 and a spatial frequency spectrum $D_{F2}(n_{sf}, n_{tf})$ of the speaker drive signal of the speaker array 25-2.

That is, the spatial frequency spectrum $D_{F1}(n_{sf}, n_{tf})$ may be calculated with the setting of the position $y_{ref}$ of the control point as $y_{ref}=y_{ref1}$ and with the drive signal $D_F(n_{sf}, n_{tf})$ of Formula (4) set to the spatial frequency spectrum $D_{F1}(n_{sf}, n_{tf})$. In contrast, the spatial frequency spectrum $D_{F2}(n_{sf}, n_{tf})$ may be calculated with the setting of the position $y_{ref}$ of the control point as $y_{ref}=y_{ref2}$ and with the drive signal $D_F(n_{sf}, n_{tf})$ of Formula (4) set to the spatial frequency spectrum $D_{F2}(n_{sf}, n_{tf})$.

At this time, when the desired sound field on the control point formed by one of the speaker arrays 25 is in inverted phase to the sound field on the control point by the other speaker array 25, the sound field formed by each of the two speaker arrays 25 would be canceled out by each other.

In order to achieve this, the sound field $P_F(n_{sf}, y_{ref}, 0, n_{tf})$ of the one speaker array 25 is to be set to $-P_F(n_{sf}, y_{ref}, 0, n_{tf})$. This corresponds to allowing one of the drive signals $D_F(n_{sf}, n_{tf})$ for each of the two speaker arrays 25, which is obtained by Formula (4), to be set to $-D_F(n_{sf}, n_{tf})$.

After acquisition of the spatial frequency spectrum $D_{F1}(n_{sf}, n_{tf})$ and the spatial frequency spectrum $D_{F2}(n_{sf}, n_{tf})$ for the two speaker arrays 25 as described above, the drive signal generation unit 22 supplies those spatial frequency spectra to the spatial frequency combining unit 23. Note that hereinafter, the spatial frequency spectrum $D_{F1}(n_{sf}, n_{tf})$ and the spatial frequency spectrum $D_{F2}(n_{sf}, n_{tf})$ will also be simply referred to as the spatial frequency spectrum $D_F(n_{sf}, n_{tf})$ unless there is no particular need to make a distinction.

Spatial Frequency Combining Unit

The spatial frequency combining unit 23 uses discrete Fourier transform (DFT) to apply spatial frequency combining on the speaker drive signal supplied from the drive signal generation unit 22, that is, on the spatial frequency spectrum $D_F(n_{sf}, n_{tf})$, so as to obtain a temporal frequency spectrum $D(l, n_{tf})$. In other words, the spatial frequency combining unit 23 uses the following Formula (7) to calculate the temporal frequency spectrum $D(l, n_{tf})$.

[Mathematical Expression 7]

$$D(l, n_{tf}) = \sum_{n_{sf}=0}^{M_{ds}-1} D_F(n_{sf}, n_{tf}) e^{-j\frac{2\pi|n_{sf}}{M_{ds}}} \tag{7}$$

Note that in Formula (7), l denotes the speaker index for identifying the speaker constituting the speaker array 25, while $M_{ds}$ denotes the number of samples of the DFT.

The spatial frequency combining unit 23 calculates the temporal frequency spectrum $D(l, n_{tf})$ for each of the speaker arrays 25, and supplies the temporal frequency spectrum $D(l, n_{tf})$ thus obtained to the temporal frequency combining unit 24. In other words, the calculation of Formula (7) is performed for each of the spatial frequency spectrum $D_{F1}(n_{sf}, n_{tf})$ and the spatial frequency spectrum $D_{F2}(n_{sf}, n_{tf})$ so as to obtain the temporal frequency spectrum $D(l, n_{tf})$.

Temporal Frequency Combining Unit

The temporal frequency combining unit 24 uses inverse discrete Fourier transform (IDFT) to apply temporal frequency combining on the temporal frequency spectrum $D(l, n_{tf})$ supplied from the spatial frequency combining unit 23 so as to obtain a speaker drive signal $d(l, n_d)$ of each of the speakers of the speaker array 25, as a temporal signal. Specifically, the temporal frequency combining unit 24 performs calculation of the following Formula (8) to calculate the speaker drive signal d(l, $n_d$).

[Mathematical Expression 8]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}} \tag{8}$$

Note that in Formula (8), $n_d$ indicates a time index, and $M_{dt}$ indicates the number of samples of the IDFT. The temporal frequency combining unit 24 calculates Formula (8) for each of the temporal frequency spectrum D(l, $n_{tf}$) of the speaker array 25-1 and the temporal frequency spectrum D(l, $n_{tf}$) of the speaker array 25-2 so as to obtain the speaker drive signal d(l, $n_d$) of each of the speaker arrays 25, and supplies the obtained signal to the speaker array 25.

Description of Locally Silenced Sound Field Forming Processing

Next, operation of the locally silenced sound field forming apparatus 11 described above will be described.

That is, hereinafter, the locally silenced sound field forming processing performed by the locally silenced sound field forming apparatus 11 will be described with reference to the flowchart of FIG. 5.

In step S11, the silenced area position acquisition unit 21 obtains a distance from the speaker array 25 to the position to be the silenced area for each of the two speaker arrays 25, and supplies the obtained distance to the drive signal generation unit 22.

For example, step S11 is used to obtain the distance $y_{ref1}$ and the distance $y_{ref2}$ from the user's position detected by a sensor as the silenced area position acquisition unit 21 and from the positions of the speaker array 25-1 and the speaker array 25-2.

Furthermore, for example, it is also allowable to first detect a user by face recognition or object recognition from an image obtained by a camera as the silenced area position acquisition unit 21 and then detect the user's position on the space on the basis of the detection result. In this case, a distance to the position to be the silenced area can be obtained from the user's position obtained and the position of the speaker array 25.

In step S12, the drive signal generation unit 22 uses the above-described Formulas (4) to (6) to calculate the spatial frequency spectrum $D_{F1}(n_{sf}, n_{tf})$ and the spatial frequency spectrum $D_{F2}(n_{sf}, n_{tf})$ of the speaker drive signal of each of the speaker arrays 25 on the basis of the distance $y_{ref1}$ and the distance $y_{ref2}$ supplied from the silenced area position acquisition unit 21. Then, the drive signal generation unit 22 supplies the obtained spatial frequency spectrum to the spatial frequency combining unit 23.

At this time, the drive signal generation unit 22 generates the two spatial frequency spectra $D_F(n_{sf}, n_{tf})$ so as to form a desired sound field on the control point, that is, in a region to be a silenced area by one spatial frequency spectrum $D_F(n_{sf}, n_{tf})$, and so as to form a sound field having an inverted phase of that of the desired sound field on the control point by the other spatial frequency spectrum $D_F(n_{sf}, n_{tf})$.

In step S13, the spatial frequency combining unit 23 calculates Formula (7) to perform spatial frequency combining on the spatial frequency spectrum $D_F(n_{sf}, n_{tf})$ supplied from the drive signal generation unit 22, and supplies the resultant temporal frequency spectrum D(l, $n_{tf}$) to the temporal frequency combining unit 24. Note that spatial frequency combining is performed for each of spatial frequency spectra $D_F(n_{sf}, n_{tf})$ of the speaker array 25.

In step S14, the temporal frequency combining unit 24 calculates Formula (8) to perform temporal frequency combining on the temporal frequency spectrum D(l, $n_{tf}$) supplied from the spatial frequency combining unit 23 so as to obtain the speaker drive signal d(l, $n_d$). Here, the speaker drive signal d(l, $n_d$) is obtained for each of the speakers of the speaker array 25.

Furthermore, the temporal frequency combining unit 24 supplies each of the speaker drive signals obtained for each of the speaker arrays 25 to each of the speaker array 25-1 and the speaker array 25-2 so as to reproduce the sound.

In step S15, the speaker array 25 reproduces the sound on the basis of the speaker drive signal supplied from the temporal frequency combining unit 24, so as to complete the locally silenced sound field forming processing.

Reproduction of the sound by the speaker array 25-1 and the speaker array 25-2 forms a sound field in which a silenced area is formed in a part of the reproduction space, that is, forms a locally silenced sound field.

As described above, the locally silenced sound field forming apparatus 11 obtains the distance to the silenced area, generates the speaker drive signal on the basis of the obtained distance, and forms a sound field by using the two speaker arrays 25 on the basis of the speaker drive signal.

With this configuration, it is possible to form a silenced area at a desired position in the depth direction as viewed from the speaker array 25, while forming a desired wave surface in the reproduction area in front and rear of the silenced area. That is, it is possible to control the silenced area in the depth direction.

Second Embodiment

Configuration Example of Locally Silenced Sound Field Forming Apparatus

Meanwhile, there might be a case, in formation of the sound field with a locally silenced area, where it is desired to frequently move the position of the silenced area and the position of the speaker array 25, such as moving the silenced area to follow the movement of the user.

In such a case, it would be sufficient to prepare a locally silencing filter for forming a sound field with a locally silenced area provided for each of distances from the speaker array 25 to the position to be a silenced area so as to generate a speaker drive signal by using the locally silencing filter.

Figure 6:
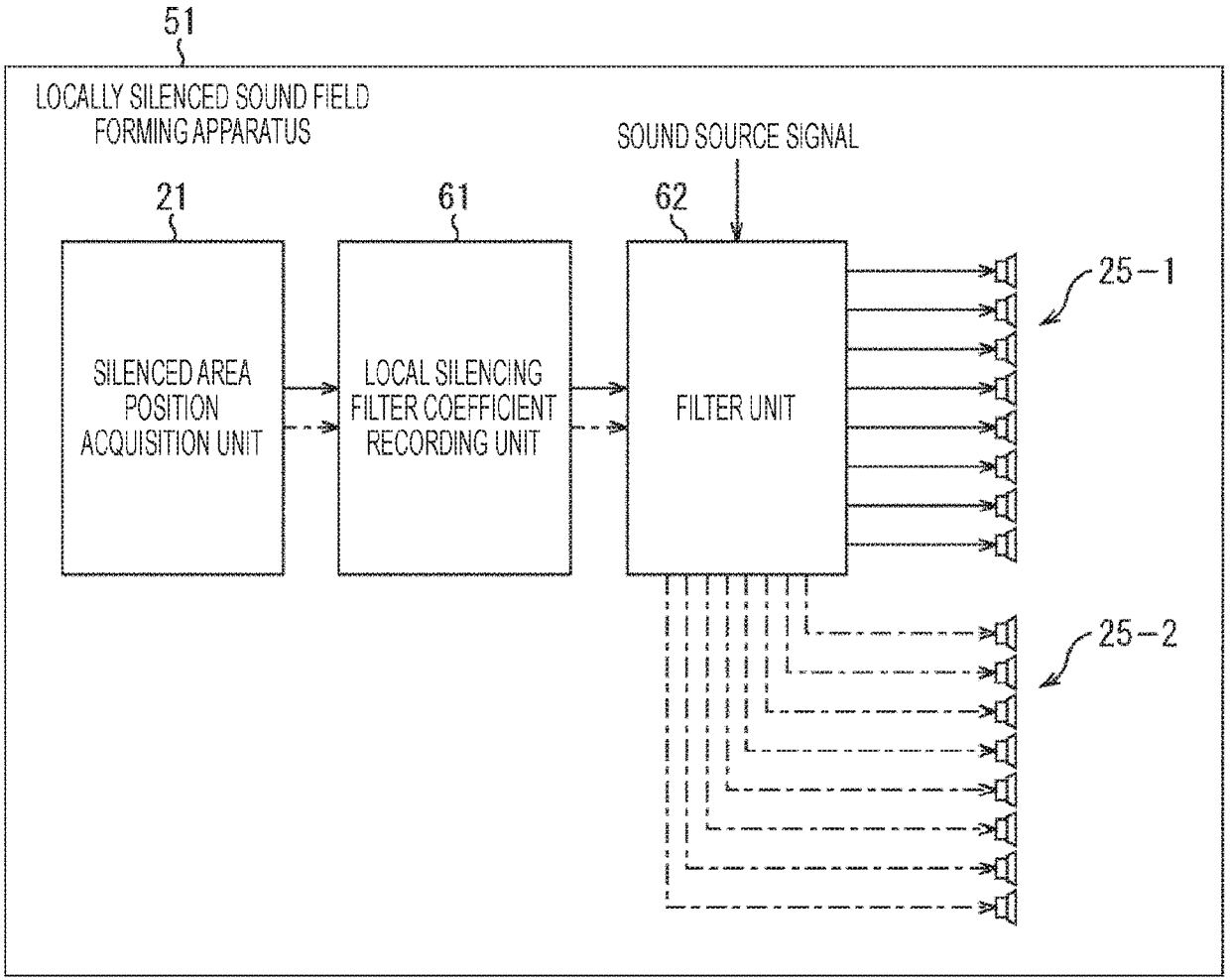
FIG. 6 is a diagram illustrating a configuration example of a locally silenced sound field forming apparatus.

In the use of the locally silencing filter in this manner, the locally silenced sound field forming apparatus is configured as illustrated in FIG. 6, for example. Note that portions in FIG. 6 corresponding to those in FIG. 4 are denoted by the same reference numerals, and description thereof is appropriately omitted.

A locally silenced sound field forming apparatus 51 illustrated in FIG. 6 includes the silenced area position acquisition unit 21, a locally silencing filter coefficient recording unit 61, a filter unit 62, the speaker array 25-1, and the speaker array 25-2.

The locally silencing filter coefficient recording unit 61 records a coefficient of a locally silencing filter being an audio filter for forming a sound field including a locally silenced area, for example, for each of distances from the speaker array 25 to the position to be a silenced area, that is, for each of the distance $y_{ref1}$ and the distance $y_{ref2}$.

On the basis of the distance $y_{ref1}$ and the distance $y_{ref2}$ supplied from the silenced area position acquisition unit 21, from among a plurality of the recorded locally silencing filter coefficients, the locally silencing filter coefficient recording unit 61 selects one locally silencing filter coefficient for each of the speaker arrays 25 and supplies the selected coefficient to the filter unit 62.

The filter unit 62 convolutes the sound source signal supplied from the outside and the filter coefficients of the locally silencing filter supplied from the locally silencing filter coefficient recording unit 61 for each of the speaker arrays 25 so as to obtain a speaker drive signal, and supplies the obtained signal to the speaker array 25.

In other words, such a filter unit 62 functions as a drive signal generation unit that generates a speaker drive signal by convoluting the locally silencing filter coefficient corresponding to the distance from the speaker array 25 to the silenced area as information regarding the silenced area together with the sound source signal.

In the locally silenced sound field forming apparatus 51 having the above-described configuration, the positions of the speaker array 25 and the silenced area are variable, making it particularly effective in a case where the position of the silenced area is frequently updated following a person, for example.

Locally Silencing Filter Coefficient Recording Unit

Subsequently, individual portions of the locally silenced sound field forming apparatus 51 illustrated in FIG. 6 will be described in more detail.

The locally silencing filter coefficient recording unit 61 records coefficients of the locally silencing filter for each of distances from the speaker array 25 to the position of the silenced area, such as the distance $y_{ref1}$ and the distance $y_{ref2}$.

When a speaker index for identifying the speaker constituting the speaker array 25 is defined as l and a time index is defined as n, this locally silencing filter is a filter having a filter coefficient h(l, n) for each of the speaker index l and the time index n.

The locally silencing filter having such a filter coefficient h(l, n) may be configured to be achieved in a similar manner as the method of calculating the speaker drive signal described in the above first embodiment, for example.

In such a case, the spatial frequency spectrum $D_F(n_{sf}, n_{tf})$ is obtained from Formulas (4) to (6) with $S(n_{tf})=1$ as the sound source signal $S(n_{tf})$ in Formula (5). Then, calculation of Formulas (7) and (8) is performed on the basis of the spatial frequency spectrum $D_F(n_{sf}, n_{tf})$, and the speaker drive signal $d(l, n_d)$ obtained from Formula (8) is defined as the filter coefficient h(l, n).

The sound source signal $S(n_{tf})=1$ in acquisition of the filter coefficient h(l, n) is set because the locally silencing filter does not depend on a sound source, that is, a sound source signal.

The locally silencing filter coefficient recording unit 61 preliminarily records filter coefficients of the locally silencing filters obtained for individual distances $y_{ref}$.

Note that more specifically, the locally silencing filter coefficient recording unit 61 records the locally silencing filter coefficients obtained for the individual distances $y_{ref}$ for each of the speaker arrays 25. For example, the locally silencing filter of the speaker array 25-1 is applied as an audio filter for forming a desired sound field, and the locally silencing filter of the speaker array 25-2 is applied as an audio filter for forming a sound field that cancels the desired sound field on the control point.

Filter Unit

A sound source signal x(n) of a sound to be reproduced is supplied to the filter unit 62. Here, n in the sound source signal x(n) represents a time index.

The filter unit 62 convolutes the supplied sound source signal x(n) and the filter coefficient h(l, n) of the locally silencing filter supplied from the locally silencing filter coefficient recording unit 61 for each of the speaker arrays 25 so as to obtain a speaker drive signal d(l, n) being a drive signal of each of the speakers of the speaker array 25. In other words, the filter unit 62 performs the calculation of the following Formula (9) to calculate the speaker drive signal d(l, n).

[Mathematical Expression 9]

$$d(l, n) = \sum_{k=0}^{N} h(l, k) \times (n - k) \tag{9}$$

Note that N represents a filter length of the locally silencing filter in Formula (9).

The filter unit 62 supplies the speaker drive signal d(l, n) thus obtained to the speaker array 25 to reproduce the sound.

Description of Locally Silenced Sound Field Forming Processing

Figure 7:
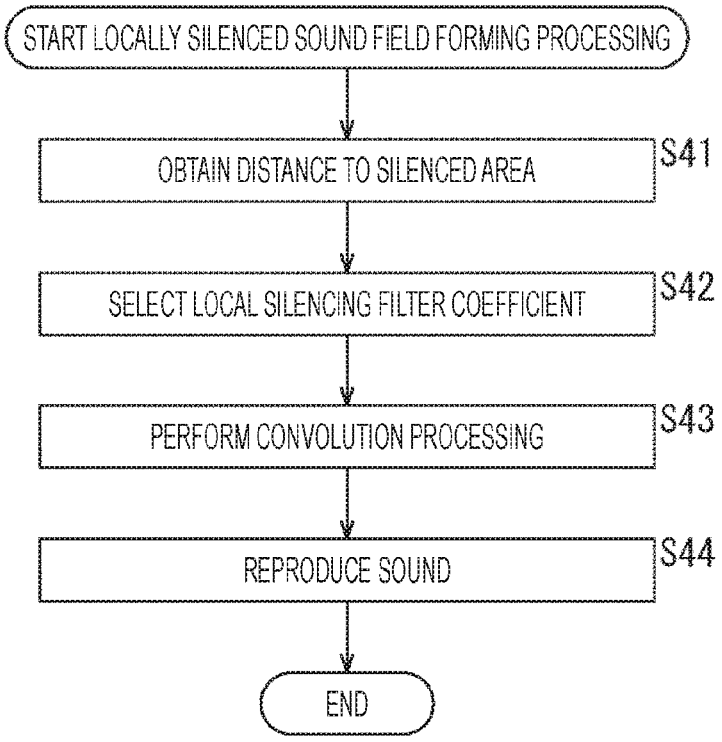
FIG. 7 is a flowchart illustrating the locally silenced sound field forming processing.

Next, operation of the locally silenced sound field forming apparatus 51 will be described. Specifically, hereinafter, locally silenced sound field forming processing performed by the locally silenced sound field forming apparatus 51 will be described with reference to the flowchart of FIG. 7.

Figure 5:
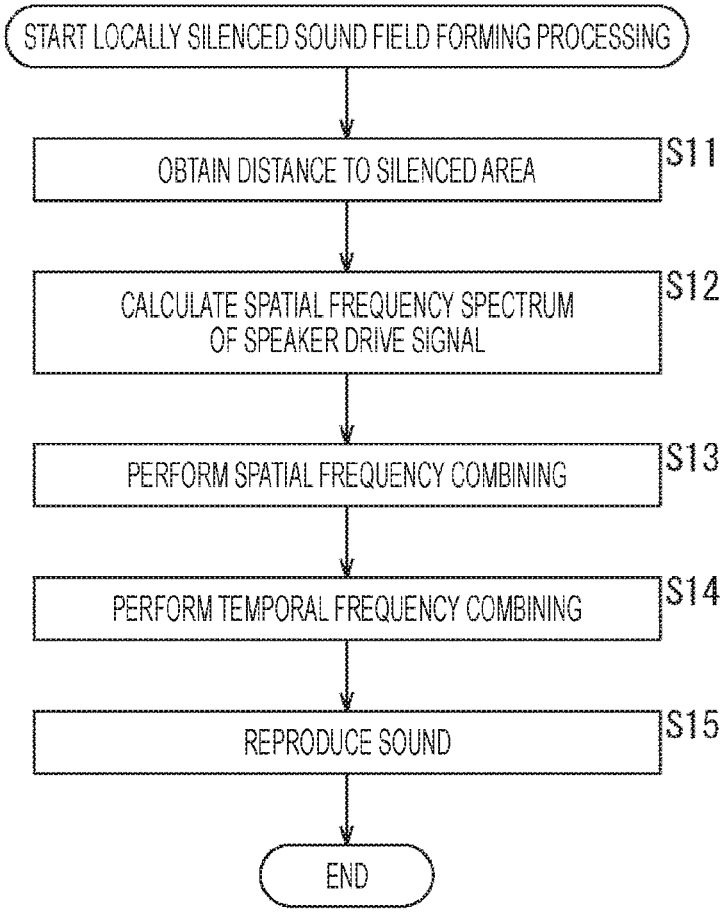
FIG. 5 is a flowchart illustrating locally silenced sound field forming processing.

Note that the processing in step S41 is similar to the processing of step S11 in FIG. 5, and thus, the description thereof will be omitted. In step S41, however, the distance $y_{ref1}$ and the distance $y_{ref2}$ obtained by the silenced area position acquisition unit 21 are supplied to the locally silencing filter coefficient recording unit 61.

In step S42, from among a plurality of the locally silencing filter coefficients recorded, the locally silencing filter coefficient recording unit 61 selects the locally silencing filter coefficient determined on the basis of the distance $y_{ref1}$ and the distance $y_{ref2}$ supplied from the silenced area position acquisition unit 21 for each of the speaker arrays 25 and supplies the selected coefficient to the filter unit 62.

In other words, the locally silencing filter coefficient recording unit 61 selects the coefficient of the locally silencing filter determined for the distance $y_{ref1}$, that is, the coefficient of the locally silencing filter having the distance $y_{ref}=y_{ref1}$ as the locally silencing filter coefficient of the speaker array 25-1, and supplies the selected locally silencing filter coefficient to the filter unit 62.

Similarly, the locally silencing filter coefficient recording unit 61 selects the locally silencing filter coefficient determined for the distance $y_{ref2}$ as the locally silencing filter coefficient of the speaker array 25-2, and supplies the selected locally silencing filter coefficient to the filter unit 62.

In step S43, the filter unit 62 performs convolution processing of the locally silencing filter coefficient supplied from the locally silencing filter coefficient recording unit 61 and the supplied sound source signal so as to generate a speaker drive signal for each of the speaker arrays 25, and supplies the generated signal to the speaker array 25.

In other words, the filter unit 62 calculates Formula (9) on the basis of the locally silencing filter coefficient of the speaker array 25-1 and the sound source signal so as to calculate the speaker drive signal d(l, n) of the speaker array 25-1, and supplies the calculated signal to the speaker array 25-1.

Similarly, the filter unit 62 calculates Formula (9) on the basis of the locally silencing filter coefficient of the speaker array 25-2 and the sound source signal so as to calculate the speaker drive signal d(l, n) of the speaker array 25-2, and supplies the calculated signal to the speaker array 25-2.

In step S44, the speaker array 25-1 and the speaker array 25-2 reproduce the sound on the basis of the speaker drive signal supplied from the filter unit 62, so as to complete the locally silenced sound field forming processing.

Reproduction of the sound by the speaker array 25-1 and the speaker array 25-2 forms a sound field in which a silenced area is formed in a part of the reproduction space, that is, forms a locally silenced sound field.

As described above, the locally silenced sound field forming apparatus 51 obtains the distance to the silenced area, as well as selecting the locally silencing filter coefficient on the basis of the obtained distance, and performs convolution processing on the basis of the locally silencing filter coefficient and the sound source signal to generate a speaker drive signal. Then, the locally silenced sound field forming apparatus 51 forms a sound field by means of the two speaker arrays 25 on the basis of the obtained speaker drive signal.

With this configuration, it is possible to form a silenced area at a desired position in the depth direction as viewed from the speaker array 25, while forming a desired wave surface in the reproduction area in front and rear of the silenced area. That is, it is possible to control the silenced area in the depth direction.

In particular, in this example, by selecting the locally silencing filter coefficients on the basis of the distance to the silenced area, it is possible to handle a change in the position of the speaker array 25 and the silenced area during reproduction of the sound such as the content sound easily and quickly.

Application Example of the Present Technology

Furthermore, the locally silenced sound field forming apparatus 11 and the locally silenced sound field forming apparatus 51 described above can be applied to the following situations and the like, for example.

In other words, there is an assumed case where sound is used on signage installed in a passage in a public place such as a station or an airport, for example. In this case, the two speaker arrays 25 may be installed to be mutually separated in the y-direction, that is, the depth direction or in the z-direction, that is, the height direction with respect to the user as a listener.

In a case where a person passes randomly in the vicinity of a signage, the timing of passing by the signage is different for each of the users, and thus, the user might not be able to hear the sound of the content from the beginning. To cope with this, there would be a method of detecting the timing at which the user passes by the signage by using a certain sensor and reproducing the sound of the content when the user passes by the signage, enabling the user to hear the sound from the beginning.

However, in a case where the second user passes by the signage before the end of the reproduction of a sound during reproduction of the sound of content at the timing when the first user passes by the signage, the sounds of different types of content for which reproduction has started at two different timings might be simultaneously audible to the two users.

At this time, the distances to the speaker array 25 of each of the users can be configured to be mutually different so as to form a silenced area in each of the user's positions to make the sound reproduced by the other user inaudible, enabling suppression of interference of two types of content at the position of each of the users.

Figure 8:
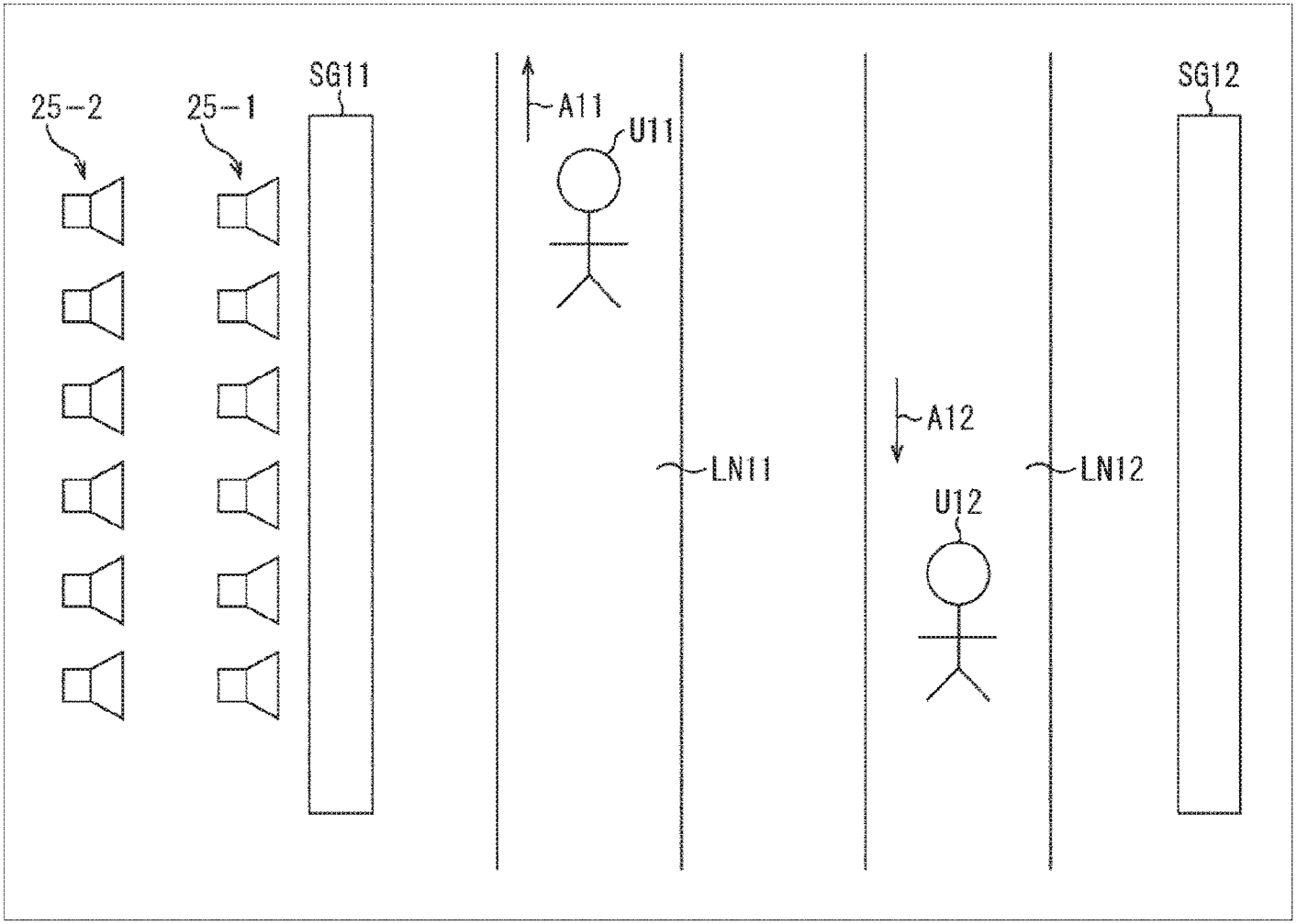
FIG. 8 is a diagram illustrating an application example of the present technology.

For example, as illustrated in FIG. 8, the speaker array 25 can be installed beside a horizontal type or ordinary staircase type escalator with a distance from the lane to the speaker array 25 being constant, enabling sound reproduction with a fixed silenced area so as to reproduce different types of content for each of the lanes. Note that portions in FIG. 8 corresponding to those in FIG. 4 are denoted by the same reference numerals, and description thereof is appropriately omitted.

In the example illustrated in FIG. 8, a user U 11 is on a lane LN 11 of the escalator moving in the direction of arrow A 11, that is, in the upward direction in the figure, while a user U 12 is in a lane LN 12 of the escalator moving in the direction of arrow A 12. Furthermore, a display SG 11 for presenting signage (content) is installed in the vicinity of the lane LN 11, while a display SG 12 for presenting signage is installed in the vicinity of the lane LN 12.

Moreover, two speaker arrays 25-1 and 25-2 are arranged in the vicinity of the display SG 11. The horizontal direction in the figure corresponds to the depth direction of the speaker array 25, that is, the y-direction illustrated in FIG. 2.

This is an example of reproducing predetermined content A on the display SG 11 for the user U 11 in the lane LN 11 while reproducing predetermined content B on the display SG 12 for the user U 12 in the lane LN 12 in this state. Here, it is assumed that the sound of the content A and the sound of the content B are reproduced by the speaker array 25.

In this case, it is possible to generate, for the content A, a speaker drive signal A having a region of the lane LN 11 as a reproduction area and a region of the lane LN 12 as a silenced area so as to make the sound of the content A inaudible to the user U 12.

Conversely, it is possible to generate, for the content B, a speaker drive signal B having a region of the lane LN 12 as a reproduction area and a region of the lane LN 11 as a silenced area so as to make the sound of the content B inaudible to the user U 11.

Then, it is possible to add the speaker drive signal A and the speaker drive signal B generated in this manner to be a speaker drive signal and reproduce the sound on the speaker array 25 on the basis of the produced speaker drive signal, so as to simultaneously reproduce the contents A and contents B. Moreover, in this case, the sound of the content A is audible only to the user U 11, while the sound of the content B is audible only to the user U 12.

First Modification of Embodiment According to Present Technology

Furthermore, while the above description is an example using two speaker arrays 25, it is also possible to use three or more (a plurality of) speaker arrays 25, for example, in the locally silenced sound field forming apparatus 11 or the locally silenced sound field forming apparatus 51.

In such a case, for example, it is possible to select arbitrary two speaker arrays 25 out of three or more (the plurality of) speaker arrays 25 to reproduce the sound by using the selected two speaker arrays 25, so as to form sound fields with different silenced area widths. In this case, for example, it is possible to determine arrangement positions and characteristics of the speaker arrays 25 so as to have a difference in the slope of the sound pressure curve of each of the speaker arrays 25 at the control point illustrated in FIG. 3 so as to vary the silenced area width using various combination of the speaker arrays 25 used for reproduction.

Figure 9:
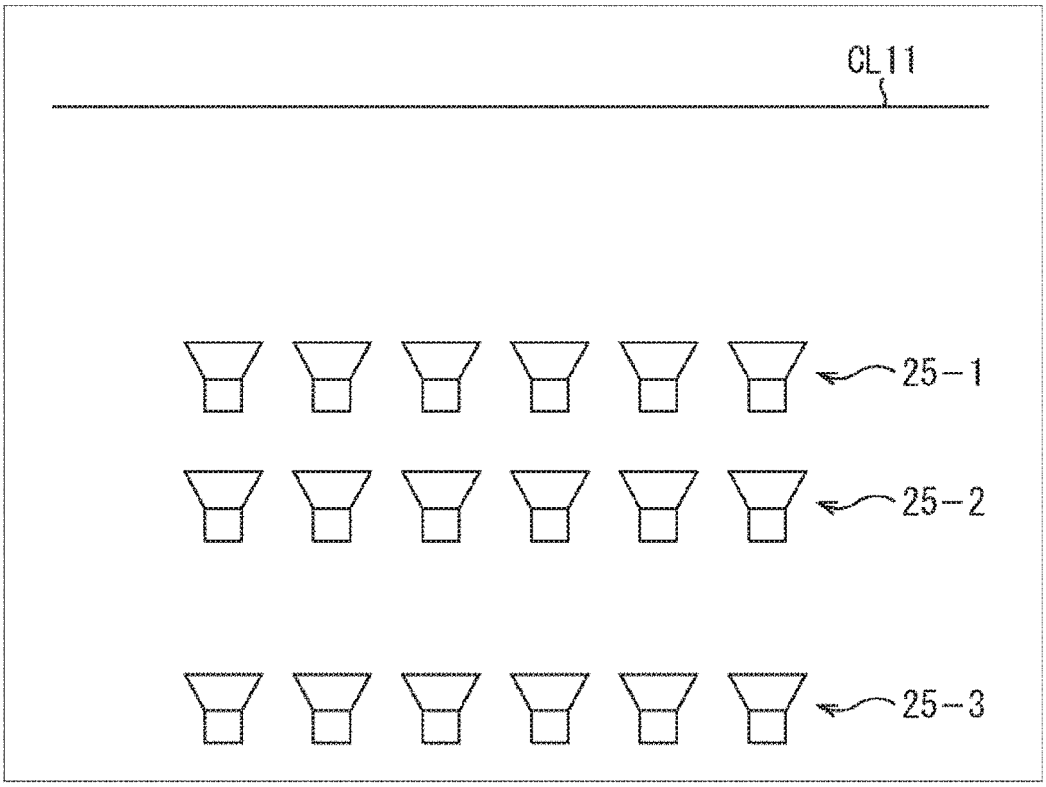
FIG. 9 is a diagram illustrating a modification of the embodiment of the present technology.

Specifically, in a case where a locally silenced sound field is to be formed using two of the three speaker arrays 25, three speaker arrays 25 are arranged as illustrated in FIG. 9, for example, in the above-described locally silenced sound field forming apparatus 11 or the locally silenced sound field forming apparatus 51. Note that portions in FIG. 9 corresponding to those in FIG. 4 are denoted by the same reference numerals, and description thereof is appropriately omitted.

In FIG. 9, the horizontal direction in the figure is the x-direction described above, and the vertical direction in the figure is the y-direction described above. In this example, three speaker arrays 25-1 to 25-3 are provided as the speaker array 25 in the locally silenced sound field forming apparatus 11 or the locally silenced sound field forming apparatus 51. Note that hereinafter, the speaker array 25-1 to the speaker array 25-3 will also be referred to simply as the speaker array 25 unless there is no particular need to make a distinction.

Each of the speaker arrays 25-1 to 25-3 is a linear speaker array formed with a plurality of speakers arranged in the x-direction. These speaker arrays 25-1 to 25-3 are arranged at different positions in the y-direction.

At the time of forming the locally silenced sound field, the speaker array 25-1 is used to form a desired sound field on a predetermined control line CL 11, while one of the speaker array 25-2 and the speaker array 25-3 is used to form a sound field having an inverted phase of that of the desired sound field on the control line CL 11.

The positions of the speaker array 25-2 and the speaker array 25-3 are arranged to have mutually different distances from the speaker array 25-1 in the y-direction.

Therefore, at the time of forming the locally silenced sound field, for example, one of the speaker array 25-2 and the speaker array 25-3 is selected in accordance with the width in the y-direction of the region to be the silenced area, etc., and a sound field having an inverted phase of that in the desired sound field is formed by the selected speaker array 25.

Note that while this is an example including two speaker arrays 25 used to form a sound field having an inverted phase of that in the desired sound field, it is of course allowable to include three or more such speaker arrays 25.

As described above, it is possible to selectively use any two out of the three or more (the plurality of) speaker arrays 25 to realize locally silenced sound field formation with higher degree of freedom.

Second Modification of Embodiment According to Present Technology

Moreover, for example, the speakers constituting the speaker array 25 may be arranged in a circular shape instead of being arranged linearly. Specifically, for example, it is possible to arrange speakers constituting a speaker array on concentric circles having different radii to perform the above-described processing so as to realize sound field formation including a locally silenced area.

Figure 10:
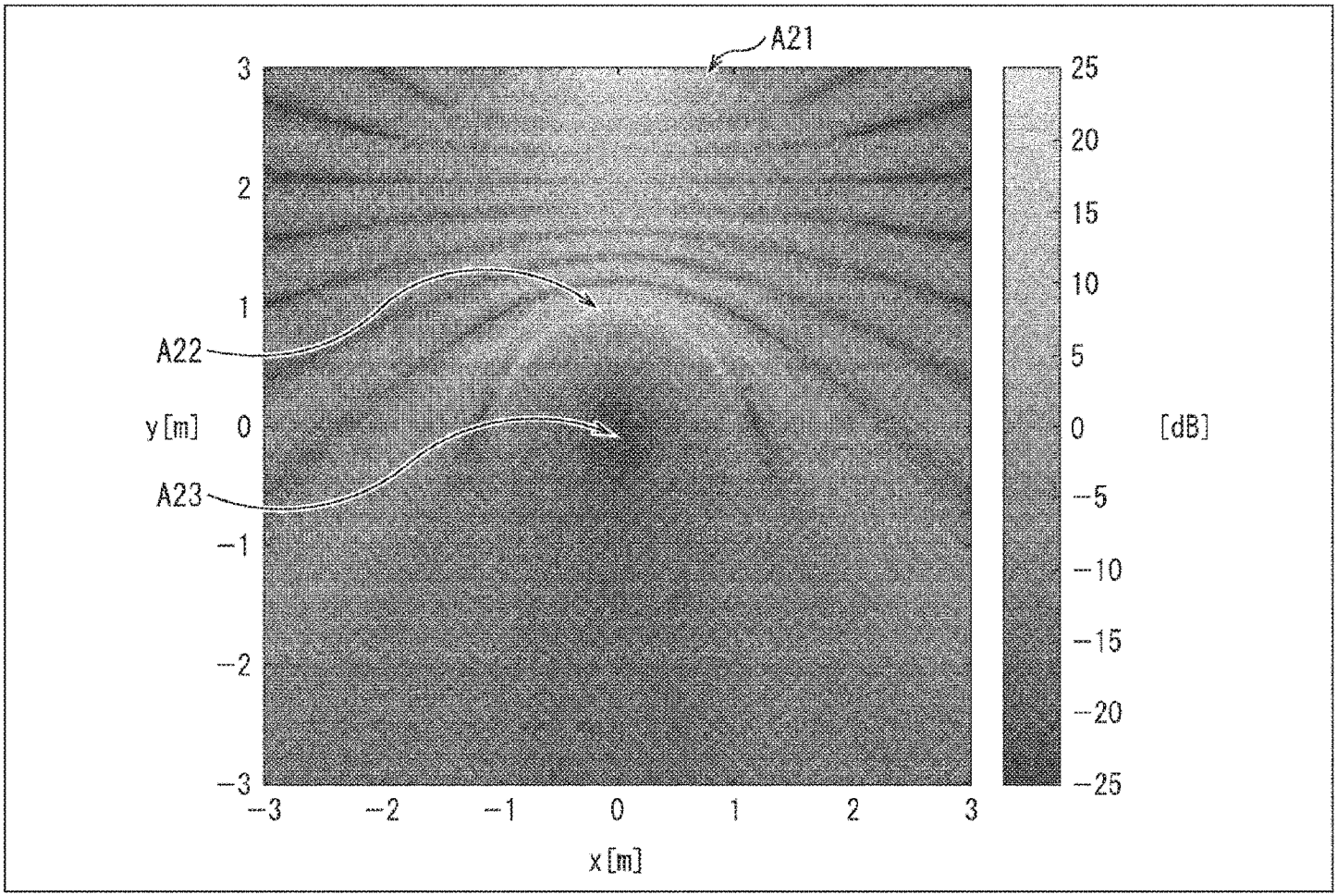
FIG. 10 is a diagram illustrating a modification of the embodiment of the present technology.

In such a case, the control point is normally at the center of the circle, and thus, for example, a silenced area is formed at the center position of the circle as illustrated in FIG. 10. In FIG. 10, the horizontal direction indicates the x-direction, while the vertical direction indicates the y-direction. Furthermore, in FIG. 10, the shading indicates the sound pressure at each of positions of the sound field formed.

In this example, speakers constituting one speaker array 25 are arranged on a circle including the position indicated by arrow A 21, and speakers constituting another speaker array 25 are arranged on a circle including the position indicated by arrow A 22.

Furthermore, the center position of the circle where the speakers of the speaker array 25 are arranged is the position indicated by arrow A 23. In other words, in this example, an annular speaker array obtained by arranging speakers on a circle centered on the position indicated by arrow A 23 is used as the speaker array 25.

In this case, it is possible to set a circular region including the position indicated by arrow A 23 as a silenced area in formation of the sound field using the two speaker arrays 25. In FIG. 10, it can be seen that the sound pressure is low in a region in the vicinity of the position indicated by arrow A 23, and that the region is a silenced area.

In this manner, the speaker array 25 is not limited to a linear speaker array, and may be realized as an annular speaker array, a spherical speaker array, a planar speaker array, or the like.

Configuration Example of Computer

Meanwhile a series of processing described above can be executed in hardware or with software. In a case where the series of processing is executed with software, a program included in the software is installed in a computer. Here, the computer includes a computer incorporated in dedicated hardware, and a general-purpose computer or the like on which various types of functions can be executed, for example, by installing various programs.

Figure 11:
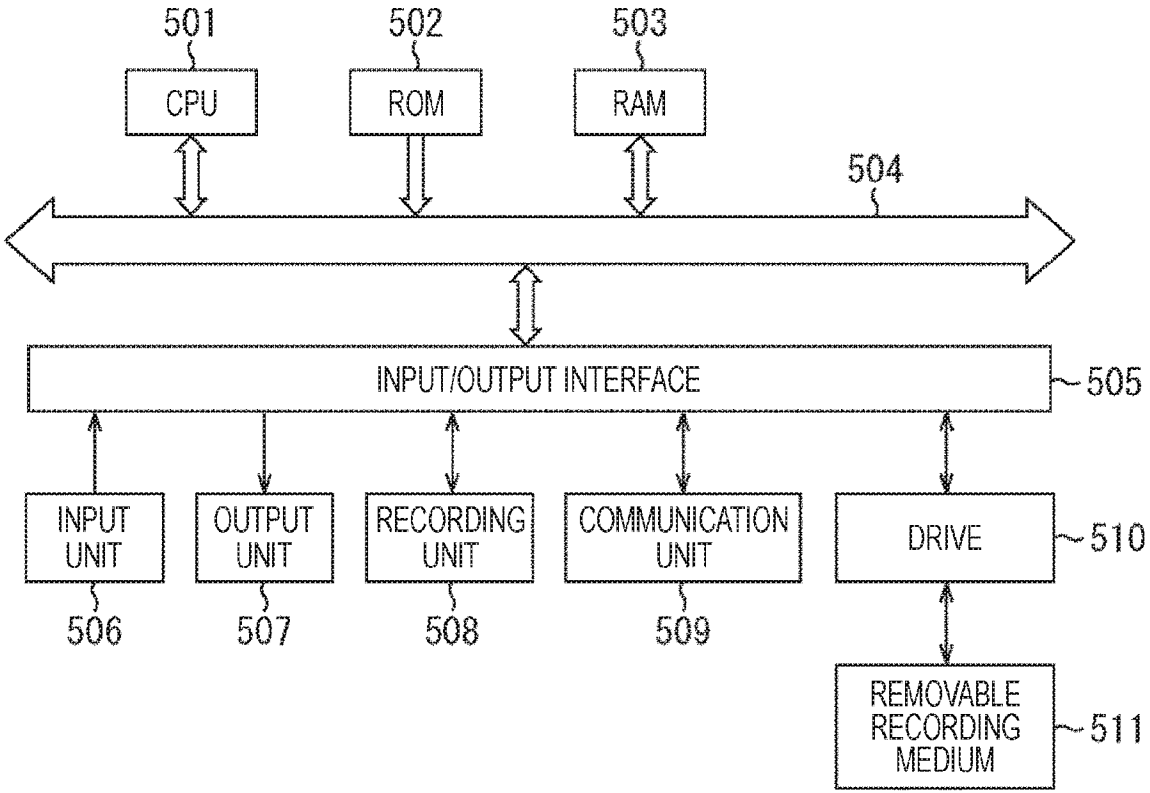
FIG. 11 is a diagram illustrating an exemplary configuration of a computer.

FIG. 11 is a block diagram illustrating an exemplary configuration of hardware of a computer that executes the series of processing described above by a program.

In a computer, a central processing unit (CPU) 501, a read only memory (ROM) 502, a random access memory (RAM) 503 are interconnected with each other via a bus 504.

The bus 504 is further connected with an input/output interface 505. The input/output interface 505 is connected with an input unit 506, an output unit 507, a recording unit 508, a communication unit 509, and a drive 510.

The input unit 506 includes a key board, a mouse, a microphone, an imaging device, and the like. The output unit 507 includes a display, a speaker array, and the like. The recording unit 508 includes hardware, a non-volatile memory, and the like. The communication unit 509 includes a network interface and the like. The drive 510 drives a removable recording medium 511 including a magnetic disk, an optical disk, a magneto-optical disk, a semiconductor memory, or the like.

On the computer configured as above, the series of above-described processing is executed by operation such that the CPU 501 loads, for example, a program stored in the recording unit 508 onto the RAM 503 via the input/output interface 505 and the bus 504 and executes the program.

The program executed by the computer (CPU 501) can be recorded, for example, in the removable recording medium 511 as a package medium or the like and be provided. Alternatively, the program can be provided via a wired or wireless transmission medium including a local area network, the Internet, and digital satellite broadcasting.

On the computer, the program can be installed in the recording unit 508 via the input/output interface 505, by attaching the removable recording medium 511 to the drive 510. In addition, the program can be received at the communication unit 509 via a wired or wireless transmission medium and be installed in the recording unit 508. Alternatively, the program can be installed in the ROM 502 or the recording unit 508 beforehand.

Note that the program executed by the computer may be a program processed in a time series in an order described in the present description, or can be a program processed in required timing such as being called.

Furthermore, note that embodiments of the present technology are not limited to the above-described embodiments but can be modified in a variety of ways within a scope of the present technology.

For example, the present technology can be configured as a form of cloud computing in which one function is shared in cooperation for processing among a plurality of apparatuses via a network.

Furthermore, each of steps described in the above flowcharts can be executed on one apparatus or shared by a plurality of apparatuses for processing.

Furthermore, in a case where one step includes a plurality of stages of processing, the plurality of stages of processing included in the one step can be executed on one apparatus or can be shared by a plurality of apparatuses.

Furthermore, effects described herein are provided for purposes of exemplary illustration and are not intended to be limiting. Still other effects may also be contemplated.

Furthermore, the present technology may be configured as follows.

(1)

A locally silenced sound field forming apparatus including:

a first speaker array that outputs a sound on the basis of a first speaker drive signal to form a predetermined sound field; and a second speaker array arranged at a position different from the position of the first speaker array and that outputs a sound on the basis of a second speaker drive signal to form a sound field that cancels the predetermined sound field.

(2)

The locally silenced sound field forming apparatus according to (1), further including:

an acquisition unit that obtains information regarding a silenced area that cancels the predetermined sound field; and a drive signal generation unit that generates the first speaker drive signal and the second speaker drive signal on the basis of the information regarding the silenced area.

(3)

The locally silenced sound field forming apparatus according to (2), in which the acquisition unit obtains, as the information regarding the silenced area, a first distance from the first speaker array to the silenced area and a second distance from the second speaker array to the silenced area.

(4)

The locally silenced sound field forming apparatus according to (3), in which the drive signal generation unit generates the second speaker drive signal that forms a sound field having an inverted phase of that in the predetermined sound field in the silenced area.

(5)

The locally silenced sound field forming apparatus according to (3) or (4), in which the drive signal generation unit generates a first spatial frequency spectrum of the first speaker drive signal on the basis of the first distance and generates a second spatial frequency spectrum of the second speaker drive signal on the basis of the second distance, and the locally silenced sound field forming apparatus further includes:

a spatial frequency combining unit that performs spatial frequency combining on each of the first spatial frequency spectrum and the second spatial frequency spectrum so as to generate a first temporal frequency spectrum and a second temporal frequency spectrum, respectively; and a temporal frequency combining unit that performs temporal frequency combining on each of the first temporal frequency spectrum and the second temporal frequency spectrum so as to generate the first speaker drive signal and the second speaker drive signal, respectively.

(6)

The locally silenced sound field forming apparatus according to (3) or (4), in which the drive signal generation unit convolutes a filter coefficient corresponding to the first distance, and a sound source signal, to generate the first speaker drive signal, and convolutes a filter coefficient corresponding to the second distance, and the sound source signal, to generate the second speaker drive signal.

(7)

The locally silenced sound field forming apparatus according to any one of (1) to (6), further including a plurality of the second speaker arrays.

(8)

The locally silenced sound field forming apparatus according to (7), in which distances between the first speaker array and each of the plurality of second speaker arrays are different from each other.

(9)

The locally silenced sound field forming apparatus according to any one of (1) to (8), in which the first speaker array and the second speaker array are each provided as a linear speaker array or an annular speaker array.

(10)

A locally silenced sound field forming method for a locally silenced sound field forming apparatus including a first speaker array and a second speaker array arranged at a different position from the first speaker array, the method including:

outputting a sound by the first speaker array on the basis of a first speaker drive signal to form a predetermined sound field; and outputting a sound by the second speaker array on the basis of a second speaker drive signal to form a sound field that cancels the predetermined sound field.

(11)

A program that causes a computer that controls a locally silenced sound field forming apparatus including a first speaker array and a second speaker array arranged at a different position from the first speaker array, to execute processing including:

outputting a sound by the first speaker array on the basis of a first speaker drive signal to form a predetermined sound field; and outputting a sound by the second speaker array on the basis of a second speaker drive signal to form a sound field that cancels the predetermined sound field.

REFERENCE SIGNS LIST

11 Locally silenced sound field forming apparatus
21 Silenced area position acquisition unit
23 Spatial frequency combining unit
24 Temporal frequency combining unit
25-1, 25-2, 25 Speaker array
61 Locally silencing filter coefficient recording unit
62 Filter unit

The invention claimed is:

1. A locally silenced sound field forming apparatus, comprising:

an acquisition unit configured to obtain information corresponding to a silenced area;

a drive signal generation unit configured to generate a first speaker drive signal and a second speaker drive signal based on the information corresponding to the silenced area;

a first speaker array configured to:

output a first sound based on the first speaker drive signal; and form a first sound field based on the output first sound; and a second speaker array at a position different from a position of the first speaker array, wherein the second speaker array is configured to:

output a second sound based on the second speaker drive signal; and form a second sound field based on the output second sound, wherein the second sound field cancels the first sound field in the silenced area.

2. The locally silenced sound field forming apparatus according to claim 1, wherein the acquisition unit is further configured to obtain, as the information corresponding to the silenced area, a first distance from the first speaker array to the silenced area and a second distance from the second speaker array to the silenced area.

3. The locally silenced sound field forming apparatus according to claim 2, wherein the first sound field has an inverted phase of that of the second sound field in the silenced area.

4. The locally silenced sound field forming apparatus according to claim 2, wherein the drive signal generation unit is further configured to:

generate a first spatial frequency spectrum of the first speaker drive signal based on the first distance; and generate a second spatial frequency spectrum of the second speaker drive signal based on the second distance, and the locally silenced sound field forming apparatus further comprises:

a spatial frequency combining unit configured to:

execute a spatial frequency combining process on each of the first spatial frequency spectrum and the second spatial frequency spectrum; and generate a first temporal frequency spectrum and a second temporal frequency spectrum, wherein the first temporal frequency spectrum is generated based on the execution of the spatial frequency combining process on the first spatial frequency spectrum, and the second temporal frequency spectrum is generated based on the execution of the spatial frequency combining process on the second spatial frequency spectrum; and a temporal frequency combining unit configured to:

execute a temporal frequency combining process on each of the first temporal frequency spectrum and the second temporal frequency spectrum; and generate the first speaker drive signal and the second speaker drive signal, wherein the first speaker drive signal is generated based on the execution of the temporal frequency combining process on the first temporal frequency spectrum, and the second speaker drive signal is generated based on the execution of the temporal frequency combining process on the second temporal frequency spectrum.

5. The locally silenced sound field forming apparatus according to claim 2, wherein the drive signal generation unit is further configured to:

convolute a first filter coefficient corresponding to the first distance, and a sound source signal;

generate the first speaker drive signal based on the convolution of the first filter coefficient and the sound source signal;

convolute a second filter coefficient corresponding to the second distance, and the sound source signal; and generate the second speaker drive signal based on the convolution of the second filter coefficient and the sound source signal.

6. The locally silenced sound field forming apparatus according to claim 1, further comprising a plurality of second speaker arrays.

7. The locally silenced sound field forming apparatus according to claim 6, wherein a third distance between the first speaker array and a third speaker array of the plurality of second speaker arrays is different from a fourth distance between the first speaker array and a fourth speaker array of the plurality of second speaker arrays.

8. The locally silenced sound field forming apparatus according to claim 1, wherein each of the first speaker array and the second speaker array is one of a linear speaker array or an annular speaker array.

9. A locally silenced sound field forming method, the method comprising:

obtaining, by an acquisition unit of a locally silenced sound field forming apparatus, information corresponding to a silenced area;

generating, by a drive signal generation unit of the locally silenced sound field forming apparatus, a first speaker drive signal and a second speaker drive signal based on the information corresponding to the silenced area;

outputting, by a first speaker array of the locally silenced sound field forming apparatus, a first sound based on the first speaker drive signal;

forming, by the first speaker array, a first sound field based on the output first sound;

outputting, by a second speaker array of the locally silenced sound field forming apparatus, a second sound based on the second speaker drive signal; and forming, by the second speaker array, a second sound field based on the output second sound, wherein the second sound field cancels the first sound field in the silenced area, and a position of the second speaker array is different from a position of the first speaker array.

10. A non-transitory computer-readable medium having stored thereon computer-executable instructions, which when executed by a processor of a locally silenced sound field forming apparatus, cause the processor to execute operations, the operations comprising:

obtaining information corresponding to a silenced area;

generating a first speaker drive signal and a second speaker drive signal based on the information corresponding to the silenced area;

outputting a first sound by a first speaker array of the locally silenced sound field forming apparatus based on the first speaker drive signal;

forming a first sound field by the first speaker array based on the output first sound;

outputting a second sound by a second speaker array of the locally silenced sound field forming apparatus based on the second speaker drive signal; and forming a second sound field by the second speaker array based on the output second sound, wherein the second sound field cancels the first sound field in the silenced area, and a position of the second speaker array is different from a position of the first speaker array.

* * * * *